US005585890A

United States Patent [19]

Handa et al.

[11] Patent Number: 5,585,890

[45] Date of Patent: Dec. 17, 1996

[54] NEURAL NETWORK CONTROLLED IMAGE COPYING APPARATUS

[75] Inventors: Yasushi Handa, Anpachi-gun; Noriyoshi Nomura, Kashihara, both of Japan

[73] Assignee: Sanyo Electric Co., LTD., Osaka-fu, Japan

[21] Appl. No.: 943,861

[22] Filed: Sep. 11, 1992

[30] Foreign Application Priority Data

Sep. 18, 1991 [JP] Japan ..... 3-268422

[51] Int. Cl.[6] ..... G03G 21/00

[52] U.S. Cl. ..... 355/208; 355/202

[58] Field of Search ..... 355/208, 243, 355/233, 38, 77, 203–209, 202, 311; 395/11, 21, 23, 163; 347/8, 14, 43, 5, 20, 23, 40

[56] References Cited

U.S. PATENT DOCUMENTS 5,025,282 6/1991 Nakamura et al. ..... 355/38
5,073,794 12/1991 Kitagawa et al. ..... 355/208
5,086,479 2/1992 Takenaga et al. ..... 382/14
5,107,300 4/1992 Miyake et al. ..... 355/208
5,109,275 4/1992 Naka et al. ..... 358/80
5,115,274 5/1992 Shibazaki et al. ..... 355/243
5,119,129 6/1992 Setani ..... 355/202
5,121,467 6/1992 Skeirik ..... 395/11
5,150,224 9/1992 Mizude et al. ..... 358/449
5,181,073 1/1993 Araki ..... 355/243
5,216,463 6/1993 Morita ..... 355/208
5,220,373 6/1993 Karaya ..... 355/204
5,255,362 10/1993 Brandstetter et al. ..... 395/163

*Primary Examiner*—Thu Anh Dang
*Attorney, Agent, or Firm*—Darby & Darby, P.C.

[57] ABSTRACT

An image forming apparatus is disclosed which, by using a neural network to have preliminarily learned input conditions for a number of characteristic originals and having only the coupling coefficient after the learning and the output calculating portion to make calculations when necessary for the controlling in the apparatus itself, is capable of automatically performing an optimum copying control corresponding to various conditions of each of various originals.

6 Claims, 7 Drawing Sheets

$$y = \frac{1}{1 + e^{-x}}$$

NEURAL NETWORK CONTROLLED IMAGE COPYING APPARATUS

BACKGROUND OF THE INVENTION

1. Field of the Invention

The present invention relates to an image forming apparatus such as an electrophotographic copying machine and a facsimile apparatus, and more particularly to an image forming apparatus which uses a neural network for controlling the automatic exposure mode in which the apparatus itself judges the condition of an original to be copied and then automatically controls various control items to form a copy image.

2. Description of the Related Art

An image forming apparatus such as an electrophotographic copying machine is conventionally so constructed as to preliminarily store various conditions of originals to be copied and various control items corresponding thereto in a data table, to read conditions of originals with use of an automatic exposure sensor when the automatic exposure mode is selected, and to read conditions of respective control items from the data table corresponding to the reading results by the automatic exposure sensor.

In order to realize the optimum copying condition fitting each original to be copied at performing automatic exposure copying, a conventional image forming apparatus like the one mentioned above requires a number of control items, for example, exposure magnitude, charging quantity, developing bias voltage and the like, which should be adjusted for each of various input conditions more accurately representing conditions of originals to be predetermined and individually controlled in a detailed manner. However, preliminarily storing a number of input conditions and all the output conditions for a plurality of control items concerning the input conditions in the form of a data table requires substantial memory area, and in addition, predetermining all conditions in detail requires substantial labor. Furthermore, it is, in fact, difficult to completely read and store conditions of all originals while carrying out automatic exposure copying.

Under these circumstances, exposure control using a neural network (neurocomputer) has been disclosed, for example, in Japanese Patent Application Laid-Open No. 2-96723 (1990), Japanese Patent Application Laid-Open No. 2-183238 (1990), and others. All of these however relate to the exposure control technique for cameras, in particular to the exposure control for taking a picture under backlight and are not applicable to an image forming apparatus. Furthermore, the present applicant in Japan has filed applications represented by Japanese Patent Application No. 2-112188 (1990) and others; these applications relate, however, to the color adjustment technique for color copying machines.

SUMMARY OF THE INVENTION

The present invention has been made in view of these circumstances, with an object for providing an image forming apparatus which is capable of performing an optimum control, by using a neural network, corresponding to various conditions of each of various originals at copying.

In order to solve the problems as mentioned above, the image forming apparatus according to the present invention uses a neural network to preliminarily learn input conditions for a number of characteristic originals. The image forming apparatus itself has only the coupling coefficient after the learning and the output calculating portion to make calculations when necessary for the control. And since completely reading conditions of all originals is difficult, control using a neural network is provided by preparing keys for setting special modes such as the photograph mode, the character mode, and the like for defining the type of an original by a user.

Therefore, the image forming apparatus according to the present invention is so constructed that the apparatus itself has only the coupling coefficient after the learning and the output calculating portion to make calculations for a plurality of input conditions and output the output conditions (the control conditions) when necessary, so that there is no need to have all input/output conditions in the form of a data table. Accordingly, the data table requires a smaller memory capacity. Further, there is no need to have the all originals as objects; learning characteristic of originals is sufficient to serve the purpose. In addition, defining special modes such as the photograph mode, the character mode, and the like leave more room for realizing an optimum control compared with the prior art.

The above and further objects and features of the invention will more fully be apparent from the following detailed description with accompanying drawings.

DESCRIPTION OF THE PREFERRED EMBODIMENTS

In the following, the present invention is described by way of the accompanying drawings showing preferred embodiments.

Figure 1:
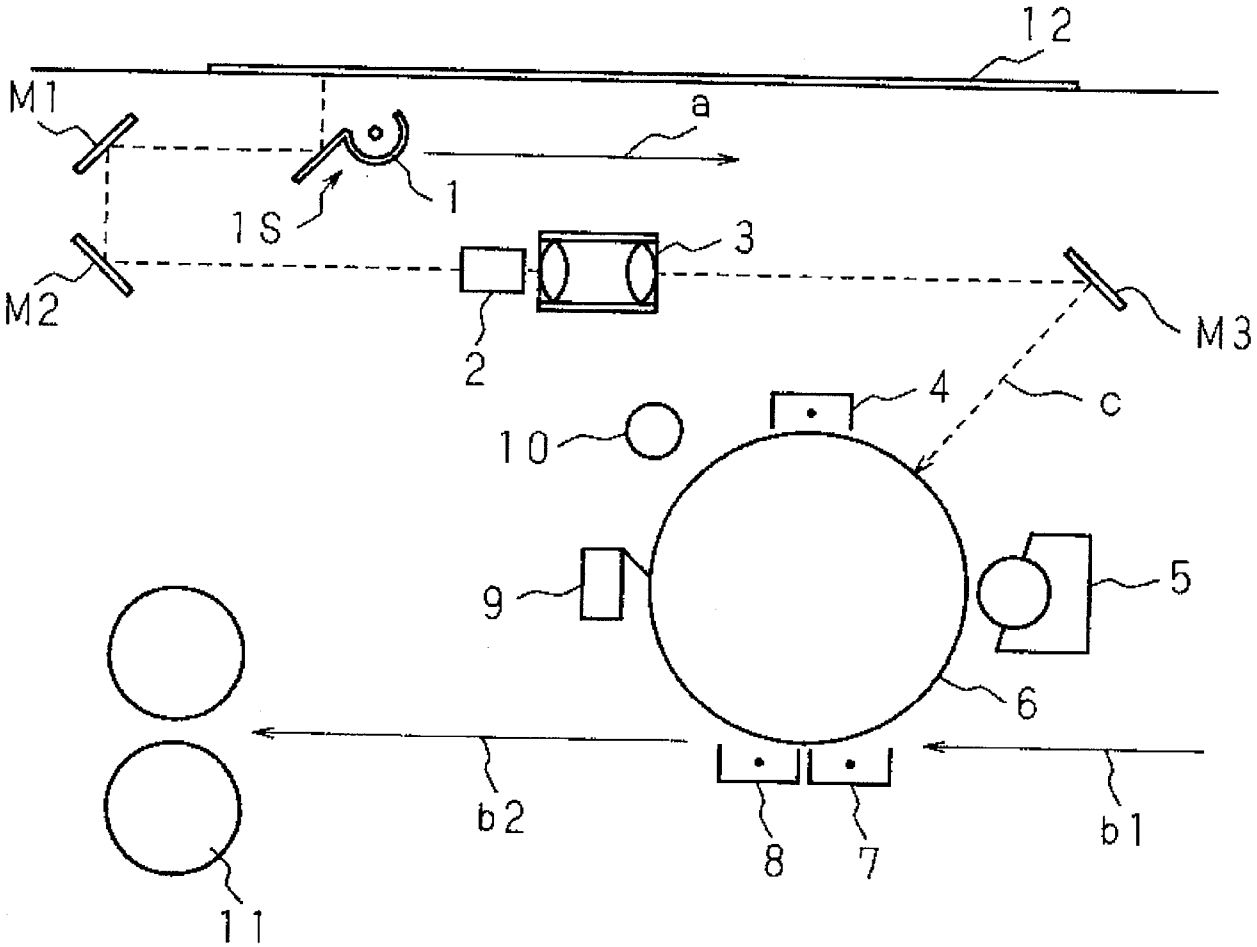
FIG. 1 is a schematic lateral sectional view showing the construction of the principal portions of a copying machine which is an exemplary embodiment of the image forming apparatus according to the present invention.

FIG. 1 is a schematic lateral sectional view showing the construction of the principal portion of a copying machine which is an exemplary embodiment of the image forming apparatus according to the present invention.

In FIG. 1, reference numeral 12 designates a table of plate glass on which to place originals to be copied. An original placed on this original table is scanned by a scanner 1S. The scanner 1S is provided with an exposure lamp 1. As the scanner 1S moves in the direction indicated by an arrow mark a, the original is exposed by the exposure lamp 1 and the reflected light by the reflecting mirrors M1 anti M2 to be inputted to the automatic exposure sensor 2 as the means for reading condition of the original.

The reflected light inputted to the automatic exposure sensor 2 reaches a photosensitive drum 6 from a zoom lens 3 via a reflecting mirror M3. Around the photosensitive drum 6, a charging corotton 4, a developing device 5, a transfer corotron 7, a separating corotton 8, a cleaning device 9, a discharging lamp 10, and the like are arranged. The photosensitive drum 6 is charged by the application of a predetermined quantity of electric charge by the charging corotron 4, and the reflected light from the reflecting mirror M3 is irradiated on the area between the charging corotton 4 and the developing device 5, thereby forming an electrostatic latent image.

The electrostatic latent image formed on the photosensitive drum 6 is developed by the developing device 5 into a toner image. The transfer corotron 7 transfers the toner image onto a sheet of copying paper which, though not shown in the figure, is conveyed along the path marked with an arrow mark b1. The sheet of copying paper, onto which the toner image has been transferred, is separated from the photosensitive drum 6 by the separating corotron 8, to be conveyed along the path marked with an arrow mark b2 to a fixing rollers 11 for the toner image to be fixed.

After the toner image has been transferred onto a sheet of copying paper, the surface of the photosensitive drum 6 is cleared of the residual toner by the cleaning device 9 and is caused to erase by the erase lamp 10 to be charged by the charging corotron 4 afresh.

Furthermore, it should be added that the image forming means is constructed of the charging corotron 4, the developing device 5, the transfer corotton 7, the separating corotron 8, the cleaning device 9, the erase lamp 10, and the like.

Figure 2:
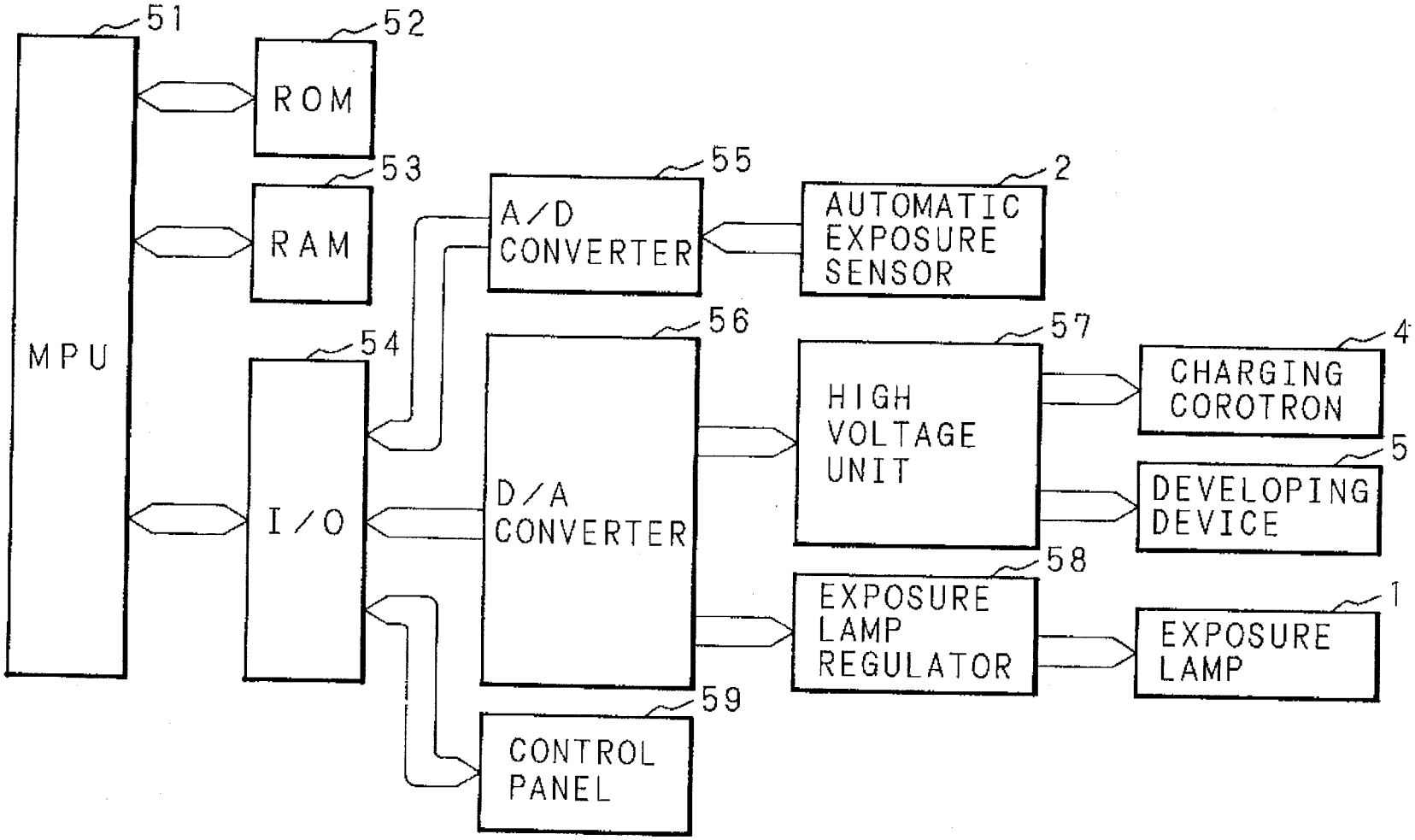
FIG. 2 is a block diagram showing the construction of the control unit of the copying machine which is an exemplary embodiment of the image forming apparatus according to the present invention.

FIG. 2 is a block diagram showing the construction of the control unit of the copying machine which is an exemplary embodiment of the image forming apparatus according to the present invention.

The copying machine which is the image forming apparatus according to the present invention is controlled by a microcomputer system including an MPU 51 as a controlling means. Connected to the MPU 51 are a ROM 52 for storing control programs, constants, and the like, a RAM 53 which for the need of control by the MPU 51 temporarily stores data and possesses various flag area necessary for the control, and an I/O interface 54 through which the MPU 51 performs input/output control of the apparatus inside the body. Furthermore, an A/D converter 55 which converts analog values into digital values, a D/A converter 56 which converts digital values into analog values, and a control panel 59 are connected to the I/O interface 54.

Connected to the A/D converter 55 is the automatic exposure sensor 2 which detects the quantity of reflected light from the original and the result obtained from the detection is converted into digital signals to be outputted to the I/O interface 54. Furthermore, a high voltage unit 57 and a exposure lamp regulator 58 are connected to the D/A converter 56. The high voltage unit 57 is intended for variably adjusting the charging quantity of the photosensitive drum 6 generated by the charging corotton 4 and the developing bias voltage of the developing device 5, and the exposure lamp regulator 58 for variably adjusting the quantity of light from the exposure lamp 1.

Figure 3:
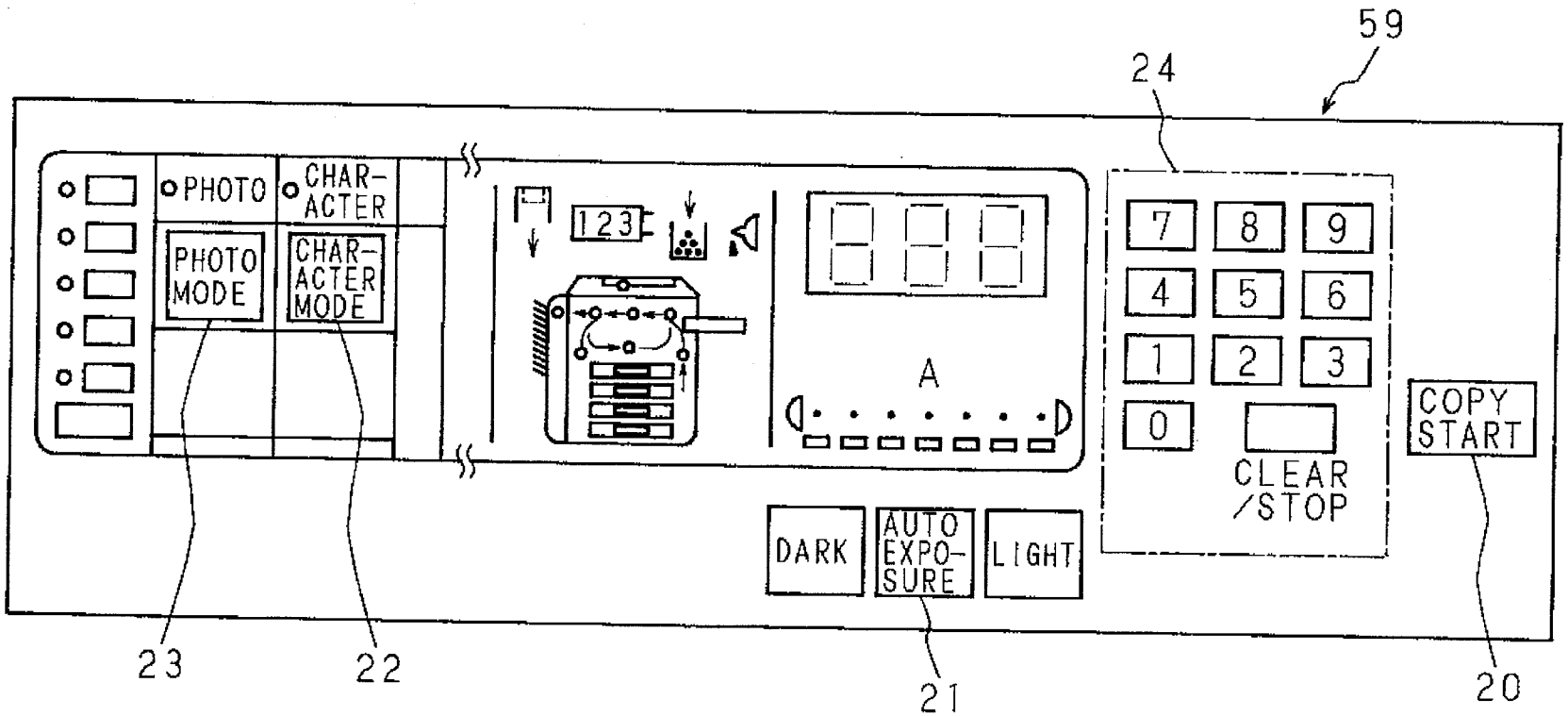
FIG. 3 is a schematic diagram showing the construction of the control panel.

FIG. 3 is a schematic diagram showing the construction of the control panel 59.

Arranged on the control panel 59 are a copy start key 20 which makes copying operation start, an automatic exposure key 21 which makes copying operation under the automatic exposure mode, a character mode key 22 which, when an original consists of an arrangement of characters, specifies the character mode, a photograph mode key 23 which, when an original consists of photographs, specifies the photograph mode, a ten-key pad 24 with which to enter the number of copies to be made and others.

In addition, the character mode key 22 and the photograph mode key 23 function as means for selecting conditions of an original.

Figure 4:
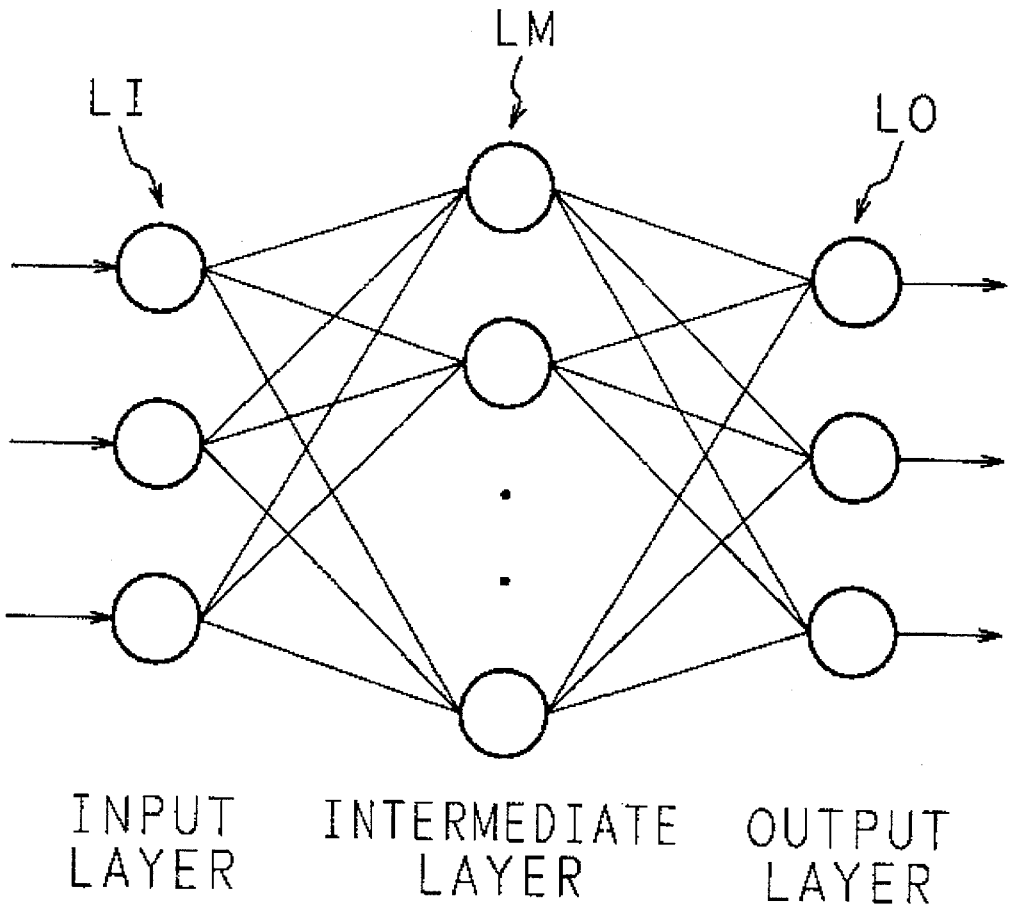
FIG. 4 is a schematic diagram showing the construction of the neural network used in the apparatus according to the present invention.

FIG. 4 is a schematic diagram showing the construction of a neural network used in the apparatus according to the present invention.

In this preferred embodiment, the neural network has a three layer construction composed of an input layer LI, an intermediate layer LM, and an output layer LO, having no coupling between units in the same layer. Each unit in a layer is coupled with each of other units in another layer through coupling coefficients (synapse weights or weight coefficient). Regarding the units in the input layer LI, the minimum value of and the average value taken from the values successively read by the automatic exposure sensor 2 during pre-scanning, and the selected mode value which has been inputted by operating either the character mode key 22 or the photograph mode key 23 on the control panel 29 are given to the respective units as input signals. From the respective units in the output layer LO, control output values for the control items such as exposure magnitude, charging quantity, and developing bias voltage are outputted.

The neural network employs a three layered back propagation as its learning scheme.

Figure 5:
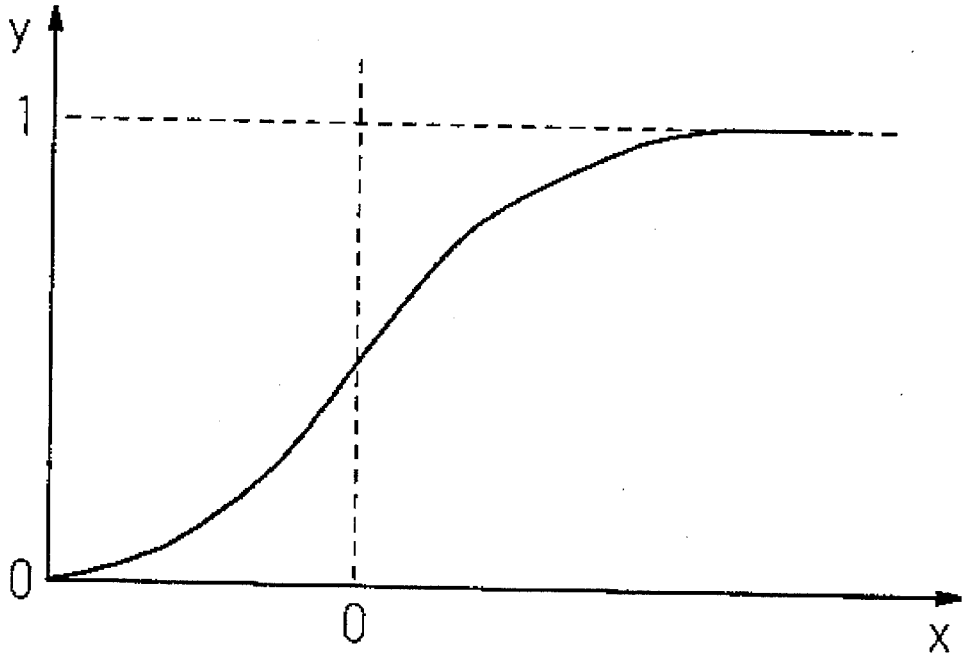
FIG. 5 is a schematic diagram of a graph showing a sigmoid type function as the input/output function for neurons in the course of back propagation.

Regarding the back propagation, a sigmoid type functions, as expressed by the Equation (1) below and shown in the graph in FIG. 5, is used as the input/output function for neurons.

$$y=1/(1+e^{-x}) \tag{1}$$

The total input $x_j$ to a neuron j is equal to, as is expressed by Equation (2) below, the value obtained through the sum of products operation on the output $y_i$ of the neuron i coupled with the neuron j through synapse and the synapse weight $w_{ij}$.

$$x_j=\epsilon y_i \cdot w_{ij} \tag{2}$$

And for the total input to the neuron j calculated by the Equation (2) above, its output is defined by Equation (3) below.

$$y_j=1/(1+e^{-x}) \tag{3}$$

The signals which have been inputted to the input layer LI according to Equations (2) and (3) above are subjected to the sequential calculation in the order of Input later *LI* → Intermediate layer *LM*
→ Output layer *LO* following the network synapse weights. The result of the calculation for the output layer LO is compared with the supervisor signal. The degree of deviation between the result of the calculation for the output layer LO and the supervisor signal is, in concrete terms, expressed by Equation (4) below, where $y_1$ denotes the i-th output layer LO, $d_i$ the supervisor signal, and E the error;

$$E=\tfrac{1}{2}\epsilon(d_i-y_i)^2 \tag{4}$$

The back propagation is the process which corrects the network synapse so as to minimize the error E.

Its learning signal δ is given by Equation (5) below for the correction from the output layer LO to the intermediate layer LM:

$$\delta_i=(d_i-y_i)f(u_i) \quad (5)$$

where $u_i$ denotes the state of the i-th neuron expressed in the foregoing equation (2) and f the sigmoid type function given by Equation (3).

Furthermore, the learning signal δ is each of the intermediate layer LM can be found from Equation (6) below, with the neuron k existing in the layer one level higher up than the neuron j.

$$\delta_i=f'(u_i)\epsilon\delta_k w_{ki} \quad (6)$$

Then, the synapse weight is determined by the rule expressed in Equation (7) below on the basis of Equations (5) and (6).

$$\Delta w_{ij}(n+1)=\eta(\delta y_i)+\alpha\Delta w_{ij}(n) \quad (7)$$

where η denotes the learning constant, and α the stabilizing constant, respectively.

Furthermore, Equation (3), an input/output functions, becomes $$f'=f(1-f)$$

making the calculation of Equations (5) and (6) easily executable.

In the learning process using the back propagation described above, in concrete terms, those who have knowledge of the developing process, namely, those referred to as experts, adjust the respective exposure magnitude, charging quantity, developing bias, which form the control items, so that copied images of originals may have an optimum image quality. The respective values adjusted then, the maximum and average value data obtained from the values read by the automatic exposure sensor on the originals involved, and the name of the related modes are recorded. And by repeating the foregoing procedure on a number of characteristic originals to be copied, the data required is collected. The data collected in this manner provide supervisor signals for the learning process using the back propagation, which personal computers and the like are made to learn to correct the network coupling coefficients to minimize the error.

Next, at the actual controlling, only data on the coupling coefficients which have completed the learning process through the back propagation and the portion which performs output calculation is one direction in the order of the neural network's input layer LI→intermediate layer LM→output layer LO are incorporated in the MPU 51. And when the automatic exposure mode is selected and the apparatus is ready to be initialized, the exposure lamp 1 turned on to scan an original to be copied (pre-scan). During the pre-scanning, the quantity of reflected light from original is successively detected by the automatic exposure sensor 2.

In this manner, the minimum value of and the average value taken from the values obtained by the automatic exposure sensor 2 are determined, and, with these values and the specified mode (whether the mode specified is the normal copy, or photograph mode, or character mode) being used as input data, the output calculation is performed according to the coupling coefficients obtained through the learning process and embedded beforehand. Since the result of the output calculation is outputted individually as the magnitudes to be controlled of exposure magnitude, charging quantity, and developing bias, they are so adjusted for copying operation as to yield an optimum image quality.

Next, the procedure of controlling the control unit by means of the MPU 51 is described with reference to the flow charts shown in FIG. 6 and FIG. 7.

Figure 6:
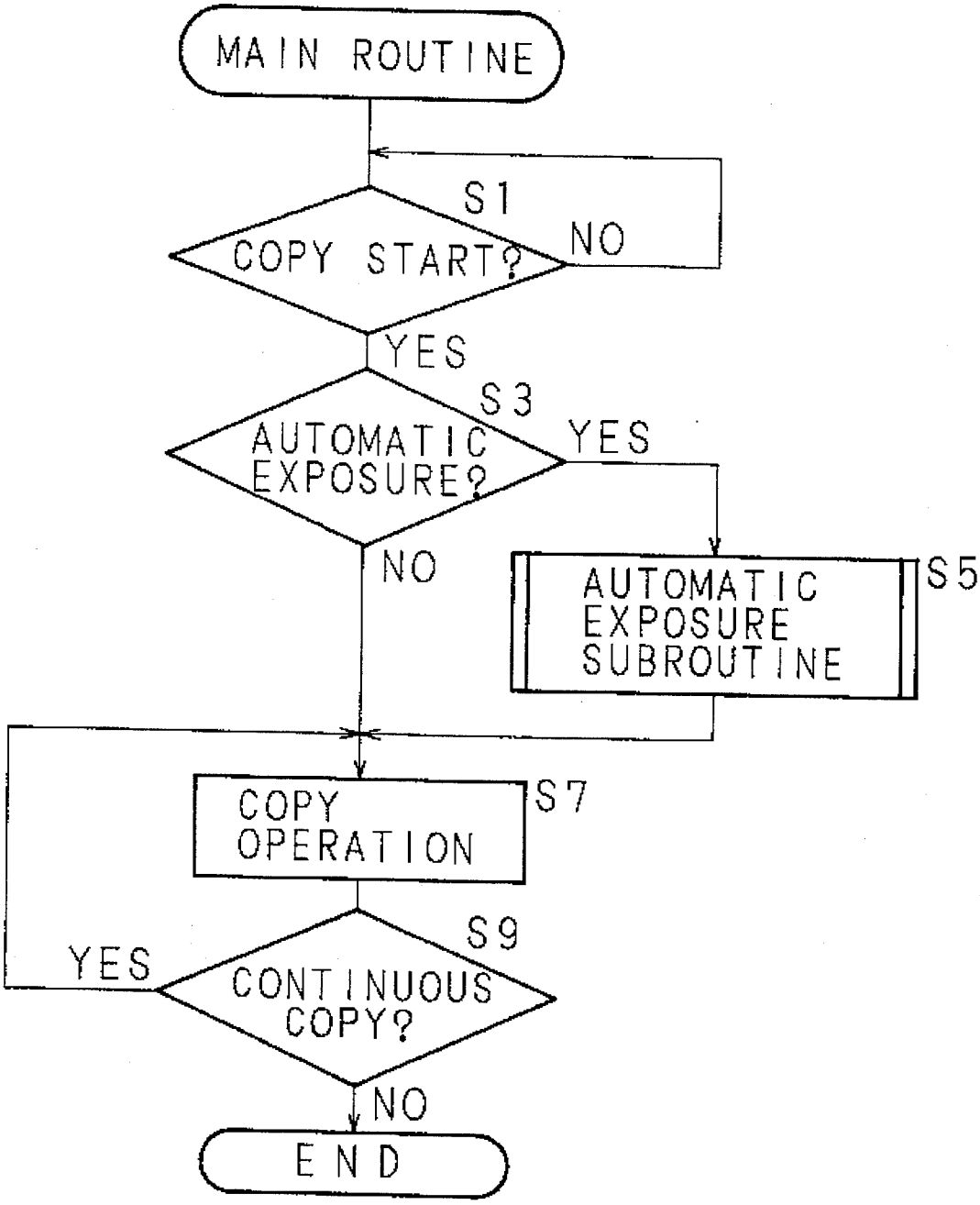
FIG. 6 is a flow chart showing the main control routine executed by an MPU.

FIG. 6 is a flow chart showing the main routine of the control by the MPU 51, according to which, in the first place, at Step S1, whether the copy start key 20 has been depressed or not is detected. In the case where the result is "NO", the standby state is continued; in the case where the result is "YES", the copying operation is started and the processing proceeds to Step S3. Detected on at this Step is whether the automatic exposure key 21 has been selected or not. In the case where the result is "YES", the automatic exposure mode has been selected, and the processing proceeds to the automatic exposure subroutine of Step 5, to be described later.

At Step S7, the copying operation, causes a series of copying processes to be executed, and at Step S9, whether the copying operation is to be repeated or not is detected. In the case where the result is "YES", the processing is returned to Step S7 for a repeated copying operation; in the case where the result is "NO", the main routine is terminated.

Figure 7:
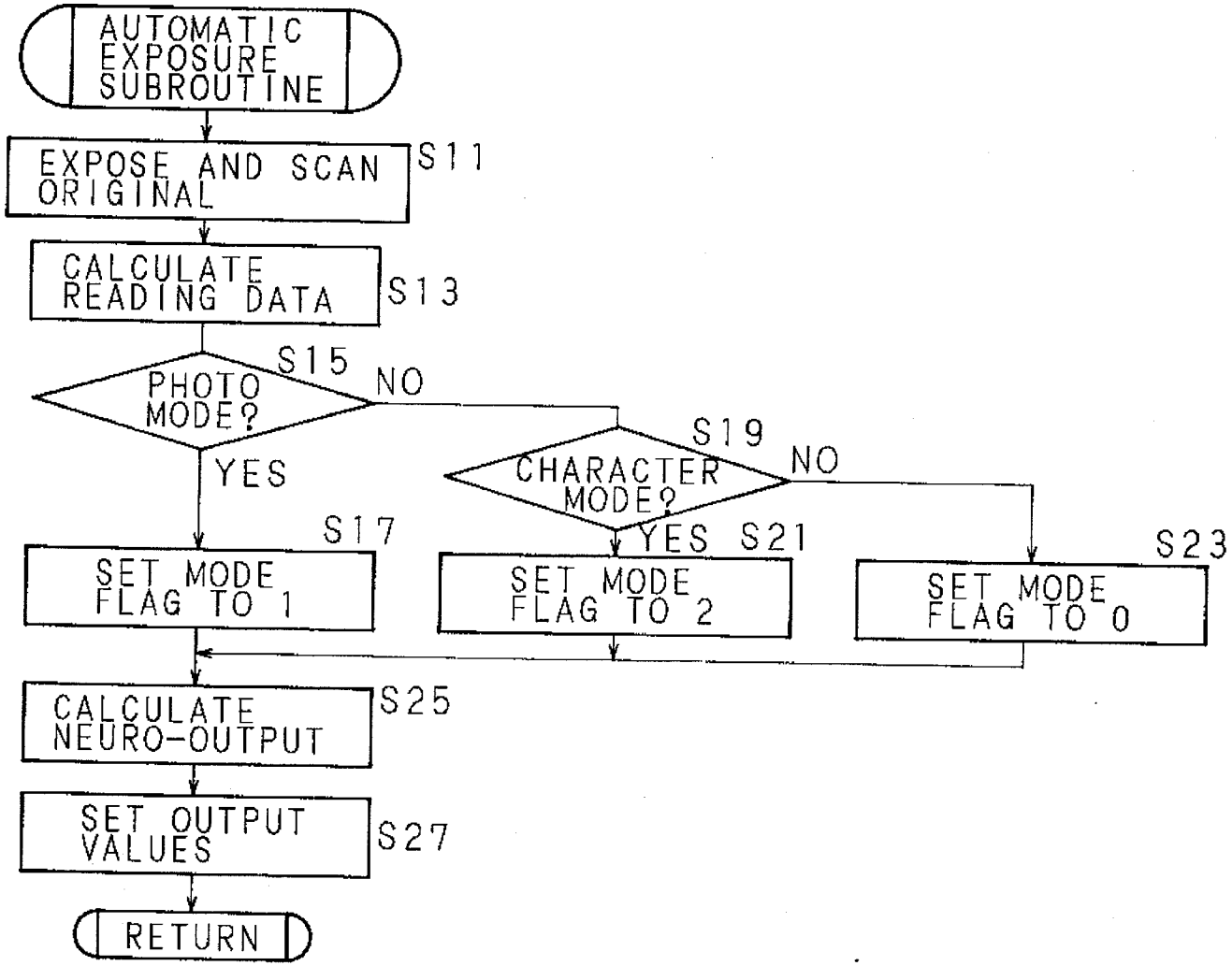
FIG. 7 is a flow chart showing the subroutine for automatic exposure.

Next, the flow chart for the automatic exposure subroutine shown in FIG. 7 is described.

In the first place, at Step S11, original exposure scanning is a processing for reading the condition of an original before subjecting it to the copying operation. Stated otherwise, at Step S11, the exposure lamp 1 is turned on and the scanner 1S is moved by the predetermined distance along the arrow mark a in the original scanning direction. Under this condition, the surface of the original to be copied is exposed by the exposure lamp 1 and the reflected light therefrom is condensed and, as is indicated by the dotted line c, reaches the photosensitive drum 6 via the reflecting mirrors M1 and M2, the automatic exposure sensor 2, the zoom lens 3, and the reflecting mirror M3. Then, the quantity of reflected light is detected by the automatic exposure sensor 2 arranged in front of the zoom lens 3.

The value of the quantity of reflected light detected by the automatic exposure sensor 2 is inputted to the MPU 51 via the A/D converter 55 and the I/O interface 54, to be finally stored in the RAM 53. This operation is repeated during the original scanning, accumulating a plurality of data in the RAM 53.

Next, at Step S13, the average value and the minimum value are read from the accumulated data in the RAM 53 in the manner described above to be stored in the RAM 53. Next, at Steps S15, S17 and S19, it is examined whether a special mode (photograph mode or character mode) has been selected or not. Stated otherwise, since additional special modes (photograph mode or character mode) are provided for the automatic exposure mode, specifying the type of an original (whether an original consists of photographs or characters) allows a far better image quality to be achieved; this is one of the objects of the present invention. And the selection of a particular mode is verified by checking which of the photograph mode key 23 or the character mode key 22 has been operated. In addition, at Steps S17, S21 and S23, when these mode have been selected, they are stored through allocating the values "0", "1", and "2" to the mode flags in the RAM 53.

Next, at Step S25, with the average value, the minimum value and the mode flag value stored in the RAM 53 being used as the input values, the output calculation for the neural network is performed by means of the foregoing Equations (2) and (3) according to the data of the coupling coefficients which have completed the learning process by the back propagation and are stored in the ROM 52 beforehand, to calculate the exposure magnitude, charging quantity, and developing bias, which form the output values of the objects to be controlled.

Next, at Step S27, the output values obtained at Step S25 are temporarily set up on the high voltage unit 57 or the exposure lamp regulator 58 via the I/O interface 54 and the D/A converter 56. The charging corotron 4, the developing device 5 and the exposure lamp 1 are controlled on the basis of these when operated for the copying operation at Step S7.

As has been described in detail, when generating a plurality of output values against a plurality of input conditions is required for the portions in need of more precise control, the present invention which, by using a neural network, eliminates the necessity of using a data table requiring a large storage area, enables a plurality of output values to be calculated and determined inside the apparatus by means of the predetermined coupling coefficients which have completed the learning process. Therefore, the present invention enables the memory capacity to be reduced, and, for the copying operation in the automatic copy mode, provides copies of an optimum image quality by allowing the condition of an original to be specified for either a photograph mode or a character mode processing and then using a neural network.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within meets and bounds of the claims, or equivalence of such meets and bounds thereof are therefore intended to be embraced by the claims.

What is claimed is:

1. Apparatus for forming a copy image of an original having a mode condition of at least one of normal, character and photographic modes comprising:

means for selecting [one of a plurality of reading the mode condition corresponding to an original being copied, each said mode condition corresponding to at least one different one of a plurality of control items of light exposure magnitude, charging quantity and developing bias voltage to be used for forming a more optimum copy image of the original;

means for exposing the original being copied to light;

first means for preliminarily irradiating the original being copied and for which the mode condition has been selected with light from said exposing means and for optically detecting reflected light values of the preliminarily irradiated original;

means for controlling the plurality of control items necessary for image forming operations according to the optical detection by said first means and the mode condition selected by said selecting means, said means for controlling including a neural network storing characteristics of the control items previously learned based on characteristics of control items corresponding to a plurality of originals of different modes, said neural network responsive to the reflected light value detected by said first means and said selected mode condition of the original being copied to modify said previously learned characteristics of the control items to automatically adjust the control items used for making the copy of the original;

a photoconductive member onto which the light from said exposing means reflected from the exposure of the original is irradiated for forming a latent image; and means controlled by said controlling means for forming a copy image of said original being copied from said latent image.

2. An image forming apparatus as set forth in claim 1, wherein said image forming means forms an image by electrophotography.

3. An image forming apparatus as set forth in claim 2, wherein said control items include exposure magnitude, charging quantity and developing bias voltage of said image forming means.

4. An image forming apparatus as in claim 1 wherein said neural network includes means for back propagation preliminary learning.

5. An image forming apparatus as in claim 1 wherein said first means optically scans an original.

6. An image forming apparatus as in claim 1 wherein said reflected light value obtained by said first means is modified by said selected reading condition.

* * * * *